United States Patent [19]

Andres et al.

[11] Patent Number: 4,484,041

[45] Date of Patent: Nov. 20, 1984

[54] MAGNETICALLY ACTUATED ELECTRIC SWITCH

[75] Inventors: Rudolf Andres, Sindelfingen; Heinz W. Knoll, Stuttgart; Volker Petri, Aidlingen, all of Fed. Rep. of Germany

[73] Assignee: Daimler-Benz Aktiengesellschaft, Stuttgart, Fed. Rep. of Germany

[21] Appl. No.: 490,372

[22] Filed: May 2, 1983

[30] Foreign Application Priority Data

May 3, 1982 [DE] Fed. Rep. of Germany ..... 3216321

[51] Int. Cl.[3] ..... H01H 35/02; H01H 9/00

[52] U.S. Cl. ..... 200/61.45 M; 335/205

[58] Field of Search ..... 200/61.45 M, 61.53, 200/61.83, 81.9 M, 82 E, 84 C; 335/205, 207; 340/669, 670

[56] References Cited

U.S. PATENT DOCUMENTS

| | | | |
|---|---|---|---|
| 2,963,563 | 12/1960 | Patterson | 200/81.9 M |
| 3,057,977 | 10/1962 | Caswell | 200/81.9 M |
| 3,327,079 | 6/1967 | Widl | 200/82 E |
| 3,569,643 | 3/1971 | Clarke et al. | 200/61.53 |
| 3,619,524 | 11/1971 | Gillund | 200/61.45 M |
| 4,181,835 | 1/1980 | Stadler et al. | 200/82 E |

*Primary Examiner*—J. R. Scott

*Attorney, Agent, or Firm*—Craig & Burns

[57] ABSTRACT

A magnetically actuated electric switch with a bistable reed switch and with a magnet adapted to be moved past the reed switch within a channel; in its normal position the magnet adheres at a soft iron core and, during occurrence of an acceleration above a predetermined threshold value, is thrown against a compression spring arranged at the other end of the channel; during the to movement, the magnet switches the reed switch into the one stable position and during the fro movement into the other stable position. The switch is suited as acceleration pick-up for vehicles, especially as impact sensor.

5 Claims, 1 Drawing Figure

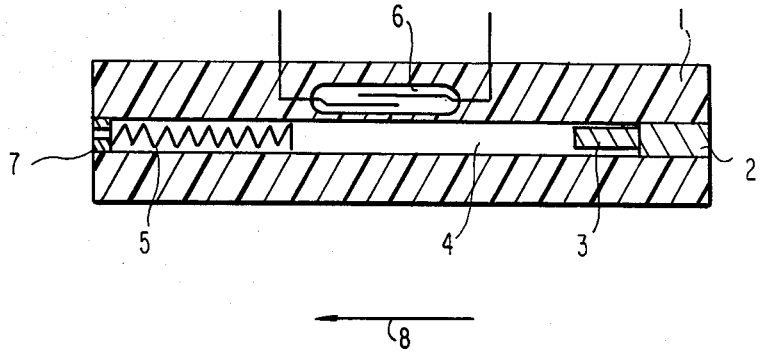
6
1
7
2
5
4
3
8

MAGNETICALLY ACTUATED ELECTRIC SWITCH

FIELD OF INVENTION

The present invention relates to a magnetically actuated electric switch, especially to an acceleration pick-up for vehicles, with a magnet adapted to be moved in a channel of the switch housing past at least one protective gas switch by acceleration forces acting on the housing in the channel direction and displaceable against the force of a spring.

DESCRIPTION OF PRIOR ART

Such a switch, in which a ring-shaped magnet is displaceable against the force of a spring on a small tube, within which a reed switch is accommodated, is disclosed in the German Offenlegungsschrift No. 26 44 606.

Acceleration switches are used in vehicles, for example, not only as impact sensors for triggering retention systems such as belt tighteners and air bags, but also for control and regulating systems as well as for diagnostic purposes.

Though the known acceleration switch is characterized by a simple construction and reliable function, it is not suitable for use as impact sensor since it operates too slowly for that purpose and does not produce a suitable signal. During the impact of a vehicle against an obstacle, the acceleration development, in principle, is of such nature that at the beginning, a phase of rapidly changing decelerations and re-accelerations is present, of some ms duration, which is followed by a second phase in which the decelerations predominate clearly. An impact sensor should produce an unequivocal signal for triggering a retention system as free of delays as possible after exceeding a predetermined acceleration threshold, i.e., with a predetermined deceleration, i.e. negative acceleration. This signal should thus take place in the first phase of the described acceleration development insofar as possible.

However, the known acceleration switch is hardly capable to perform in this manner because it cannot follow the rapid directional changes of the acceleration against the spring force and owing to its own inertia, as would be required. The magnet of such prior art construction will therefore reach the vicinity of the protective gas switch only in the second phase and will thereafter close and open the same several times relatively briefly by reason of its "shaking" movement, which might be described as "contact chatter."

SUMMARY OF INVENTION

Accordingly, it is the aim of the present invention to improve the prior art acceleration switch in such a manner that it is capable to be suited also as impact sensor, i.e., is capable, when exceeding the desired acceleration threshold, of producing an unequivocal signal of sufficiently long duration for subsequent further processing with as little delay as possible.

The underlying problems are solved according to the present invention in that the magnet in its normal position adheres to a soft iron core member arranged at one end of the channel, from which the magnet is adapted to be disengaged by an acceleration force acting on the switch above an upper threshold value, in that the spring is so dimensioned that it is compressed by the magnet released from its normal position in the presence of an acceleration force acting on the switch above a lower threshold value and the magnet thereby nearly reaches its end position and that the spring, after the disappearance of the acceleration, pushes the magnet back at least so far that it is again pulled into the normal position by its own magnetic forces, and in that the protective gas switch is a bistable reed switch, is located outside of the channel and is so arranged that it is switched by the magnet into the other position only when the magnet is located approximately in the center during its movement between its normal, rest position and the end position.

It is possible by such a construction in accordance with the present invention to keep the magnet very small, which results in a low mass and a rapid response. When the magnet tears itself loose from the soft iron in the presence of a predetermined acceleration force, the magnet initially flies freely within the channel until it impinges against the spring which the magnet compresses as a result of its impulse. This occurs during the first phase of the impact. The reed switch is thereby switched from its "normal" or "rest" position into the other stable position. During the rapid changes between deceleration and acceleration of the first phase and during the subsequent second phase, the magnet is disposed near its end position outside of the position, in which it can act on or influence the reed switch. Only when the forces acting on the switch again decrease or decay, the material is thrown back by the spring in the direction toward its normal position and the reed switch is thereby returned into its original stable "normal", rest position. As a result thereof, a sufficiently long chatter-free switching signal is produced by the reed switch. The movement progress of the magnet, in addition to being influenced by the construction of the channel and the magnet, can be further influenced by an opening or throttle at the end of the channel.

BRIEF DESCRIPTION OF THE DRAWING

These and further objects, features and advantages of the present invention will become more apparent from the following description when taken in connection with the accompanying drawing which shows, for purposes of illustration only, one embodiment in accordance with the present invention, and wherein:

The single FIGURE is a cross-sectional view through a magnetically actuated electric switch in accordance with the present invention.

DETAILED DESCRIPTION OF INVENTION

Referring now to the single FIGURE of the drawing, a channel or passageway 4, formed for example, by a bore, is machined into a housing 1 of non-magnetic material, which is closed off on one side by a soft iron member 2 and, on the other side, by an insert 7 which has a throttle opening. A compression spring 5, rigidly connected with the insert 7, is arranged in the channel 4 while a magnet 3 is freely movably arranged between the compression spring 5 and the soft iron core 2; the magnet is held fast in its normal, rest position at the soft iron 2 by reason of its attraction force. A bistable reed switch 6 of known construction is so arranged in the housing 1 near the channel 4 that its contacts are switched by the magnet 3 moved past the same into the one or the other stable position thereof depending on the direction of movement, in a manner known as such, as will be described more fully hereinafter.

In order to achieve the desired effect, the magnet, the channel and the compression spring must fulfill certain conditions. The magnet 3 must have such an attraction force that it becomes disengaged from the soft iron 2 in the presence of a predetermined acceleration force acting on the magnet and on the entire switch in the direction of the channel—referred to as upper acceleration threshold—and then "flies" in the channel 4 against the compression spring 5 by movement from the soft iron member 2 toward the spring 5. The compression spring 5 and the mass of the magnet 3 must be matched to one another in such a manner that the magnet, when it has become detached from its normal, rest position, compresses the compression spring 5 already in the presence of a smaller acceleration force than the upper acceleration threshold—to be referred to hereinafter as lower acceleration threshold. Finally, the mass of the magnet 3 must be so large that the magnet has sufficient inertia so that it remains near its end position during the following rapid changes of decelerations and accelerations in the first phase, without thereby reaching the switching area of the reed switch.

The operation of the acceleration switch securely installed in a vehicle during an impact thereof against an obstacle will be described hereinafter.

The switch is so installed in the vehicle that the channel 4 is arranged parallel to the driving direction which is indicated in the drawing by an arrow 8. If the vehicle now impacts against an obstacle, the body thereof and therewith the acceleration switch is initially subjected to a deceleration. If this deceleration is larger than the upper acceleration threshold value, the magnet 3 becomes detached from the soft iron core 2 and "flies" within the channel 4 in the direction toward the compression spring 5 past the reed switch 6. The reed switch 6 is constructed as known bistable reed switch, i.e., its contacts are magnetic—one a north pole and the other a south pole—and mutually attract each other. However, the magnetization is so weak that open contacts cannot close by themselves by their mutual attraction, yet is so strong that the contacts, once closed, remain "glued" at one another. As a result of the external interaction of the magnet 3, the known bistable effect is thus produced. It is assumed in the illustrated embodiment that in the normal, rest position, the magnet 3 adheres to the soft iron core 2. The contacts of the reed switch are opened also in the normal position. The magnet flying past the reed switch 6 in the direction of the arrow 8 causes a closing of the contacts of the reed switch 6. The magnet spends the rest of the first phase of alternating accelerations and decelerations and the second phase of predominantly decelerations near its end position by reason of the alternate effects between its inertia resulting from its weight and the spring action. If the decelerations disappear near the end of the impact, the spring 5 "shoots" the magnet 3 back in the direction toward its normal position opposite the direction of the arrow 8. The magnet 3 thereby passes the contacts of the reed switch 6 in the opposite direction and causes the opening thereof. Subsequently, it reaches the area of its attraction toward the soft iron core 2 and finally adheres at the same.

For influencing the "flight velocity" of the magnet, an opening is provided in the insert 7 closing the channel 4, through which air can flow in or out during the movement of the magnet in order to oppose as little resistance as possible to the movements of the magnet.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A magnetically actuated electric switch comprising a switch housing with a channel therein, at least one protective gas switch means, a magnetic means operable to move within the channel of the switch housing past the switch means by accelerations acting on the housing in the channel direction, a soft iron member at one end of the channel and a spring means arranged at the other end of the channel, the magnet means in its normal, rest position adhering to the soft iron member and being detached from the soft iron member when an acceleration force acting on the switch exceeds an upper threshold value;

the spring means being compressed by the detached magnet means when an acceleration force acting on the switch exceeds a lower threshold value and allows the magnet means to nearly reach its end position, and the spring means, upon disappearance of the acceleration force, being operable to subsequently return the magnet means at least so far that it is again pulled into its normal, rest position by its own magnetic forces; and the protective gas switch means being a bistable reed switch means located outside of the channel and being switched by the magnet means into the other stable position only when the magnet means is approximately located in the center between the normal and end positions.

2. A switch according to claim 1, wherein an insert means provided with an opening is arranged at the end of the channel coordinated to the end position of the magnet means.

3. A switch according to claim 2, wherein said opening is a throttle opening.

4. A switch according to claim 3, wherein the switch is an acceleration pick-up switch for vehicles to detect the presence of predetermined acceleration forces.

5. A switch according to claim 1, wherein the switch is an acceleration pick-up switch for vehicles to detect the presence of predetermined acceleration forces.

* * * * *